US011578534B2

(12) United States Patent
Al-Gouhi

(10) Patent No.: US 11,578,534 B2
(45) Date of Patent: Feb. 14, 2023

(54) LIFTING HYDROCARBONS

(71) Applicant: Saudi Arabian Oil Company, Dhahran (SA)

(72) Inventor: Alwaleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/185,208

(22) Filed: Feb. 25, 2021

(65) Prior Publication Data

US 2022/0268099 A1 Aug. 25, 2022

(51) Int. Cl.

| | |
|---|---|
| ***E21B 3/02*** | (2006.01) |
| ***F04B 47/04*** | (2006.01) |
| ***E21B 43/12*** | (2006.01) |

(52) U.S. Cl.

CPC ..... *E21B 3/022* (2020.05); *E21B 43/126* (2013.01); *E21B 43/129* (2013.01); *F04B 47/04* (2013.01)

(58) Field of Classification Search

CPC ..... E21B 43/126; E21B 43/129; F04B 47/04
See application file for complete search history.

(56) References Cited

U.S. PATENT DOCUMENTS

| | | | | |
|---|---|---|---|---|
| 4,805,697 | A * | 2/1989 | Fouillout | E21B 43/385 166/265 |
| 6,454,010 | B1 * | 9/2002 | Thomas | F04C 13/008 417/423.6 |
| 7,337,851 | B2 * | 3/2008 | Hall | E21B 43/126 166/84.1 |
| 8,147,217 | B2 * | 4/2012 | Lengert | E21B 43/126 417/372 |
| 8,191,619 | B2 | 6/2012 | Orban | |
| 8,439,119 | B2 * | 5/2013 | Sheth | E21B 43/128 166/242.6 |
| 8,789,609 | B2 * | 7/2014 | Smith | E21B 47/18 166/372 |
| 11,208,999 | B2 * | 12/2021 | Straub | E21B 43/128 |
| 2003/0044299 | A1 | 3/2003 | Thomas et al. | |
| 2015/0114632 | A1 | 4/2015 | Romer et al. | |
| 2015/0226208 | A1 * | 8/2015 | Shaw | F04D 1/06 417/377 |
| 2016/0312590 | A1 * | 10/2016 | Chang | E21B 33/12 |
| 2021/0202147 | A1 * | 7/2021 | Li | H02K 15/03 |
| 2022/0090467 | A1 * | 3/2022 | Manning | E21B 34/08 |

* cited by examiner

*Primary Examiner* — Jonathan Malikasim
(74) *Attorney, Agent, or Firm* — Fish & Richardson P.C.

(57) ABSTRACT

A drive fluid inlet is at an uphole end of the submersible pump top drive. A removable hydraulic motor is driven by drive fluid received by the drive fluid inlet. The removable hydraulic motor is separable from a downhole pump. A receiver is at a downhole end of the hydraulic motor. The receiver is configured to mate with the downhole pump. A drive fluid outlet is configured to expel the drive fluid after the drive fluid has flowed through the hydraulic motor. The drive fluid outlet is downhole of the drive fluid inlet.

19 Claims, 6 Drawing Sheets

LIFTING HYDROCARBONS

TECHNICAL FIELD

This disclosure relates to artificial lift systems that can be used in hydrocarbon production.

BACKGROUND

In hydrocarbon production, some geologic formations lack enough pressure in the reservoir to economically realize production through the well to the surface. Downhole pumps or compressors can be deployed into the well to increase production. Additionally or alternatively, a topside compressor or pump are sometimes used to extend the life of the well by decreasing pressure at the top of the well. In instances where pumps or compressors are deployed into a well, such devices can be driven by topside facilities, and are appropriately referred to as "top driven". Such systems can include shaft driven submersible pumps, where an extended shaft extends into the wellbore between a topside driver and a downhole pump, or they can include hydraulic submersible pumps (HSP). Alternatively or in addition, downhole equipment with its own driver, such as an electric submersible pump (ESP), can be used.

SUMMARY

This disclosure describes technologies relating to lifting hydrocarbons from geologic formations.

An implementation of the subject matter described within this disclosure is a submersible pump top drive with the following features. A drive fluid inlet is at an uphole end of the submersible pump top drive. A removable hydraulic motor is driven by drive fluid received by the drive fluid inlet. The removable hydraulic motor is separable from a downhole pump. A receiver is at a downhole end of the hydraulic motor. The receiver is configured to mate with the downhole pump. A drive fluid outlet is configured to expel the drive fluid after the drive fluid has flowed through the hydraulic motor. The drive fluid outlet is downhole of the drive fluid inlet.

An aspect of the example submersible pump top drive, which can be combined with the example submersible top drive alone, or in combination with other aspects, includes the following. The drive fluid inlet is configured to connect to inlet tubing fluidically connecting the top drive to a fluid drive source at a topside facility.

An aspect of the example submersible pump top drive, which can be combined with the example submersible top drive alone, or in combination with other aspects, includes the following. Return tubing is configured to connect the drive fluid outlet to a topside facility. The return tubing isolates the drive fluid outlet from production fluids.

An aspect of the example submersible pump top drive, which can be combined with the example submersible top drive alone, or in combination with other aspects, includes the following. The return tubing surrounds the inlet tubing forming a return annulus defined by an inner surface of the return tubing and an outer surface of the inlet tubing.

An aspect of the example submersible pump top drive, which can be combined with the example submersible top drive alone, or in combination with other aspects, includes the following. A packer is located between the drive fluid outlet and the submersible pump.

An aspect of the example submersible pump top drive, which can be combined with the example submersible top drive alone, or in combination with other aspects, includes the following. The receiver includes a central profile defining a rotatable receptacle configured to receive a corresponding profile at an uphole end of a downhole pump shaft.

An aspect of the example submersible pump top drive, which can be combined with the example submersible top drive alone, or in combination with other aspects, includes the following. The profile includes a hexagonal shape.

An aspect of the example submersible pump top drive, which can be combined with the example submersible top drive alone, or in combination with other aspects, includes the following. The drive fluid outlet is fluidically coupled to a production stream.

An example implementation of the subject matter within this disclosure is a method with the following features. A removable hydraulic motor positioned within a wellbore receives a drive fluid from a topside facility. A hydraulic motor shaft is rotated in response to receiving the drive fluid. A submersible pump shaft, coupled to the hydraulic motor shaft to rotate in unison, is rotated in response to rotating the hydraulic motor shaft. Fluids are produced from a wellbore to the topside facility by the submersible pump.

An aspect of the example method, which can be combined with the example method alone or in combination with other aspects, includes the following. The drive fluid is emitted from the hydraulic motor. The drive fluid is isolated from the producing fluids. The drive fluid is returned to the topside facility.

An aspect of the example method, which can be combined with the example method alone or in combination with other aspects, includes the following. The drive fluid is emitted from the hydraulic motor. The drive fluid and the producing fluids are commingled with one another. The commingled drive fluid and producing fluid are flowed to the topside facility.

An aspect of the example method, which can be combined with the example method alone or in combination with other aspects, includes the following. The hydraulic motor is received by the submersible pump.

An aspect of the example method, which can be combined with the example method alone or in combination with other aspects, includes the following. The hydraulic motor is separated from the submersible pump.

An aspect of the example method, which can be combined with the example method alone or in combination with other aspects, includes the following. The hydraulic motor or a second hydraulic motor is received after separating the hydraulic motor from the submersible pump.

An example of implementation of the subject matter in this disclosure is a submersible pump system with the following features. A top drive includes a hydraulic motor. A drive fluid inlet is at an uphole end of the top drive. The drive fluid inlet is configured to receive a drive fluid from a topside facility to drive the hydraulic motor. An inlet tubing fluidically connects the drive fluid inlet to a fluid drive source at a topside facility. A receiver with a central profile defines a rotatable receptacle with a specified profile configured to receive a corresponding profile at an uphole end of a downhole pump shaft. A drive fluid outlet is configured to emit the used drive fluid. A submersible pump is configured to move a wellbore fluid from a geologic formation to a topside facility. The submersible pump is driven by the top drive. The submersible pump includes a shaft with a shaft profile configured to mate with the specified profile to transfer torque between the hydraulic motor and the submersible pump. The top drive is removable from the submersible pump while the submersible pump remains within a wellbore.

An aspect of the example submersible pump system, which can be combined with the example submersible pump system alone or in combination with other aspects, includes the following. A return tubing is configured to connect the drive fluid outlet to a topside facility. The return tubing isolates the drive fluid outlet from production fluids.

An aspect of the example submersible pump system, which can be combined with the example submersible pump system alone or in combination with other aspects, includes the following. The return tubing surrounds the inlet tubing forming a return annulus defined by an inner surface of the return tubing and an outer surface of the inlet tubing.

An aspect of the example submersible pump system, which can be combined with the example submersible pump system alone or in combination with other aspects, includes the following. A packer is located downhole of the drive fluid outlet.

An aspect of the example submersible pump system, which can be combined with the example submersible pump system alone or in combination with other aspects, includes the following. The specified profile includes a hexagonal shape.

An aspect of the example submersible pump system, which can be combined with the example submersible pump system alone or in combination with other aspects, includes the following. The drive fluid outlet is fluidically coupled to a production stream.

Particular implementations of the subject matter described in this disclosure can be implemented so as to realize one or more of the following advantages. The concepts described herein allow for modular overhaul of hydraulic submersible pump drivers and pumps. The concepts described herein can yield an HSP that has depth capabilities similar to that of an ESP, particularly when compared to top drive pumps such as a sucker rod pump and a rod driven progressive cavity pump. The top drive described within this disclosure can be deployed without the need for a rig.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describe a hydraulic submersible pump system (HSP) that includes a hydraulic motor top drive with a drive fluid inlet at an uphole end of the top drive. Tubing, such as coiled tubing, fluidically connects the drive fluid inlet to a fluid drive source at a topside facility. The top drive is modular and easily separable from the downhole pump. As such, the top drive includes a receiver with a central profile defining a rotatable receptacle configured to mate with a corresponding shaft at an uphole end of the downhole pump.

Figure 1:
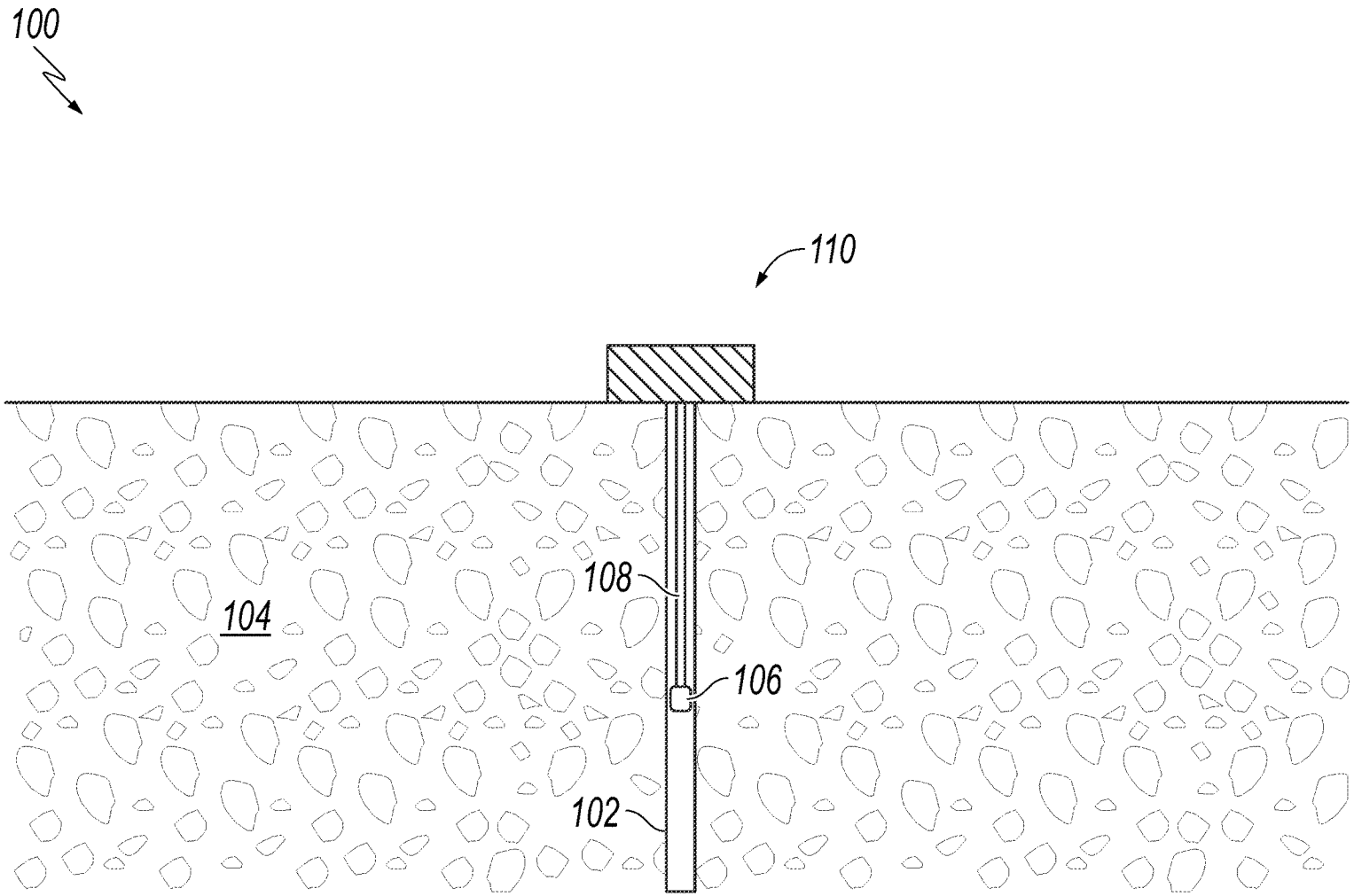
FIG. 1 is side view of an example hydrocarbon production facility.

FIG. 1 is side view of an example hydrocarbon production facility 100. The hydrocarbon production facility 100 includes a wellbore 102 formed within a geologic formation 104 to produce hydrocarbons. While primarily described in the context of producing hydrocarbons, the concepts described herein can be similarly applied to other applications, such as water production, without departing from this disclosure. Within the wellbore 102 is an artificial lift system 106 that includes a downhole-type (or submersible) pump. The wellbore produces production fluids (for example, hydrocarbons) to a topside facility 108 where the production fluids can be further conditioned for refinement or transport. The topside facility 108 can include pumps, compressors, separators, power generators, and any other facilities necessary for producing and conditioning hydrocarbons. Though illustrated as a vertical wellbore for simplicity, the wellbore 102 can be a horizontal or deviated wellbore without departing from this disclosure.

Figure 2:
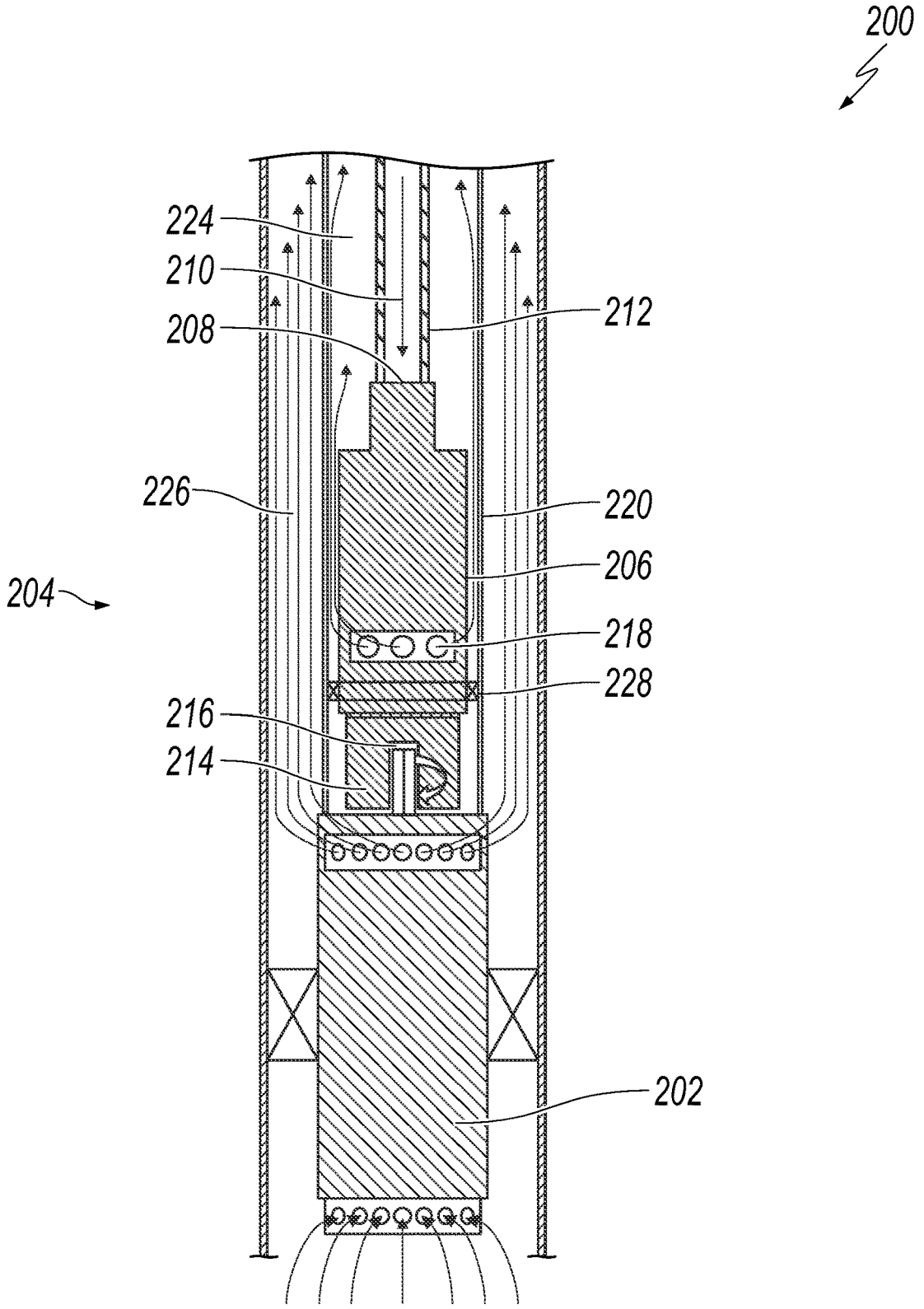
FIG. 2 is a side cross-sectional view of an example downhole-type pump driven by a hydraulic top drive.

FIG. 2 is a side cross-sectional view of an example HSP 200 with a downhole-type pump 202 driven by a hydraulic top drive 204. The illustrated arrangement can be used as the artificial lift system 106. The hydraulic top drive 204 includes a hydraulic motor 206. The hydraulic motor 206 includes a drive fluid inlet 208 at an uphole end of the top drive 204. The drive fluid inlet 208 is configured to receive a drive fluid 210, for example, from the topside facility 108 (FIG. 1) to drive the hydraulic motor 206. An inlet tubing 212 fluidically connects the drive fluid inlet 208 to a fluid drive source at the topside facility 108. Such pressurized fluid sources can include topside pumps, pressure vessels, inflatable bladders, or any other pressure source capable of delivering the required pressures and flowrates to drive the hydraulic motor 206 for a duration of time suitable for artificial lift systems, for example, several months at a time. The inlet tubing 212 can, in some implementations, include coiled tubing, eliminating the need for a rig to deploy and retrieve the top drive 204.

At a downhole end of the top drive 204 is a receiver 214 with a central profile 216 defining a rotatable receptacle with a specified profile configured to receive a corresponding profile at an uphole end of a downhole pump shaft. That is, the receiver includes a female portion that receives a male portion of the downhole-type pump 202. While primarily illustrated and described as having a female receiver on the top drive 204 and a male shaft on the downhole-type pump, such an arrangement can be reversed without departing from this disclosure. Regardless of the arrangement, the male and female profiles are configured to couple to exchange torque between the top drive 204 and the downhole-type pump 202. In some implementations, the profile can include a hexagonal shape. In some implementations, other profiles can be used, for example, a square profile, or a standard spline profile.

In some implementations, the top drive 204 is set atop the downhole-type pump 202 through trial and error until the receiver successfully receives the submersible pump shaft. Vertical, horizontal, and rotational movements can be used to achieve coupling. In some implementations, centralizers, keyways, or other alignment mechanisms can be used without departing from this disclosure.

Downhole of the drive fluid inlet 208 is a drive fluid outlet 218. The drive fluid outlet 218 expels or emits the drive fluid 210 after the drive fluid 210 has been used to drive the hydraulic motor 206. In some implementations, the used drive fluid is received by a return tubing 220 that is configured to connect the drive fluid outlet 218 to the topside facility 108. The return tubing 220 isolates the drive fluid outlet 218 from production fluids 226. That is, the used drive fluid 210 is not commingled with the production fluid 226. In such an implementation, the return tubing 220 surrounds the inlet tubing 212 to form a return annulus 224 defined by an inner surface of the return tubing 220 and an outer surface of the inlet tubing 212. The return annulus 224 is further isolated from the production fluid 226 by a packer 228 located between the drive fluid outlet 218 and the downhole-type pump 202.

In some implementations, other tubing arrangements can be used. For example, rather than using coaxially arranged tubing, a return tubing running adjacent and parallel to the inlet tubing 212 can be used without departing from this disclosure.

Downhole of the top drive 204 is a downhole-type pump 202, also known as a submersible pump, configured to move a production fluid 226 from the geologic formation 104 (FIG. 1) to the topside facility 108. As previously described, the submersible pump is driven by the top drive 204. The downhole-type pump 202 can be a centrifugal pump, a positive displacement pump, or a combination of the two, so long as it can be driven by the rotational portion provided by the top drive 204.

In some implementations, no clocking or anti-rotation devices are needed to prevent rotation of the top drive 204 relative to the downhole-type pump 202. Instead, a combination of weight on the submersible pump, friction, and torsional stiffness of the drive fluid tubing 212 is sufficient to prevent unwanted rotation. Implementations that do include anti-rotation mechanisms, such as keyways or clamps, can be used without departing from this disclosure.

Figure 3:
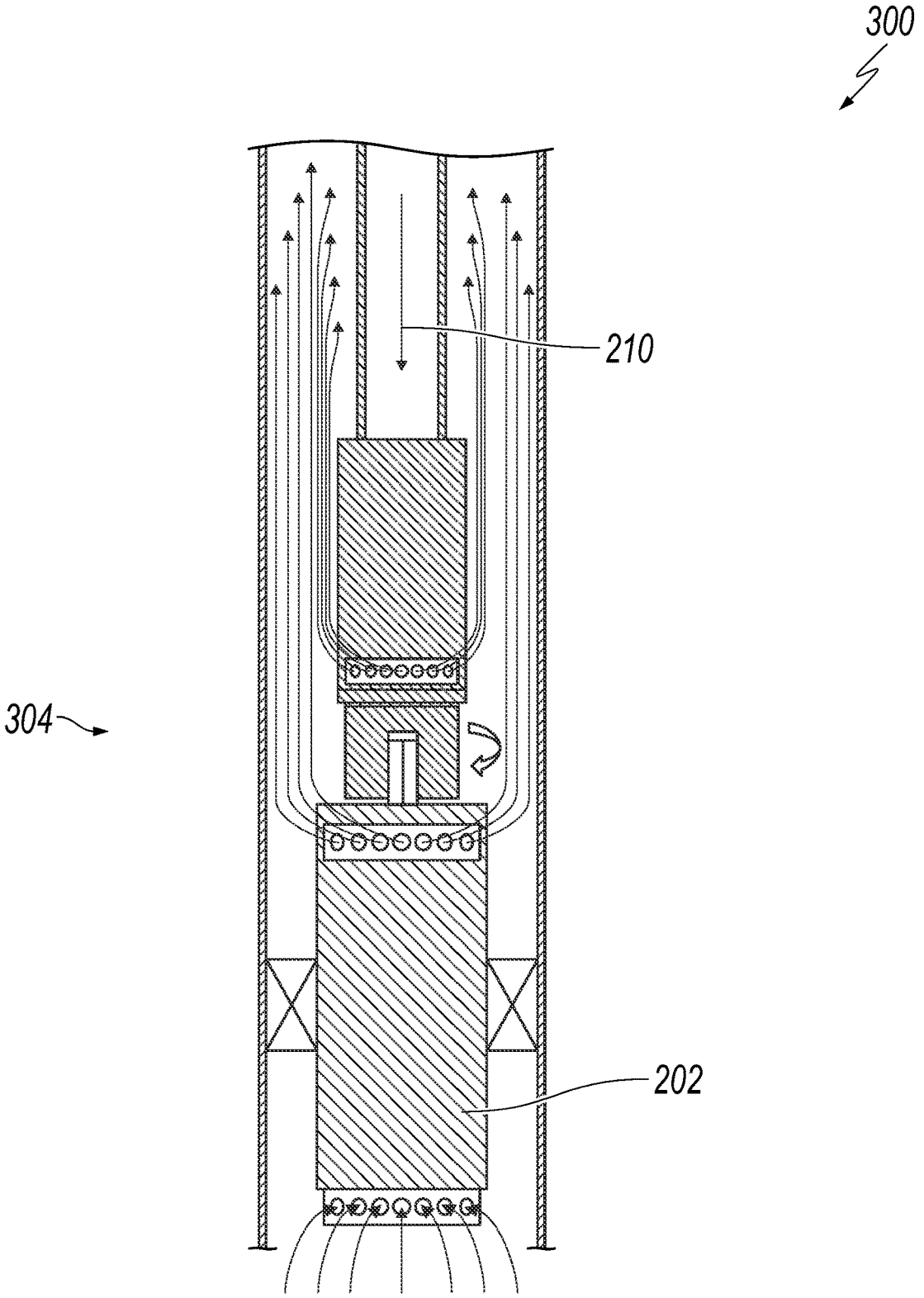
FIG. 3 is a side cross-sectional view of an example downhole-type pump driven by a hydraulic top drive.

FIG. 3 illustrates an example HSP 300 with a downhole-type pump 202 driven by a hydraulic top drive 304. The hydraulic top drive 304 is substantially similar to the hydraulic top drive 204 in FIG. 1, with the exception of any differences described herein. The illustrated arrangement lacks return tubing 220 (FIG. 2). As a result, the used drive fluid 210 is expelled from the top drive 204 and commingled with the production fluid 226. In such implementations, the drive fluid can be separated from the production fluid at the topside facility. In some implementations, the drive fluid is compatible with the production fluid, such as when conditioned, dead oil is used, and as a result, no separation is needed.

Figure 4:
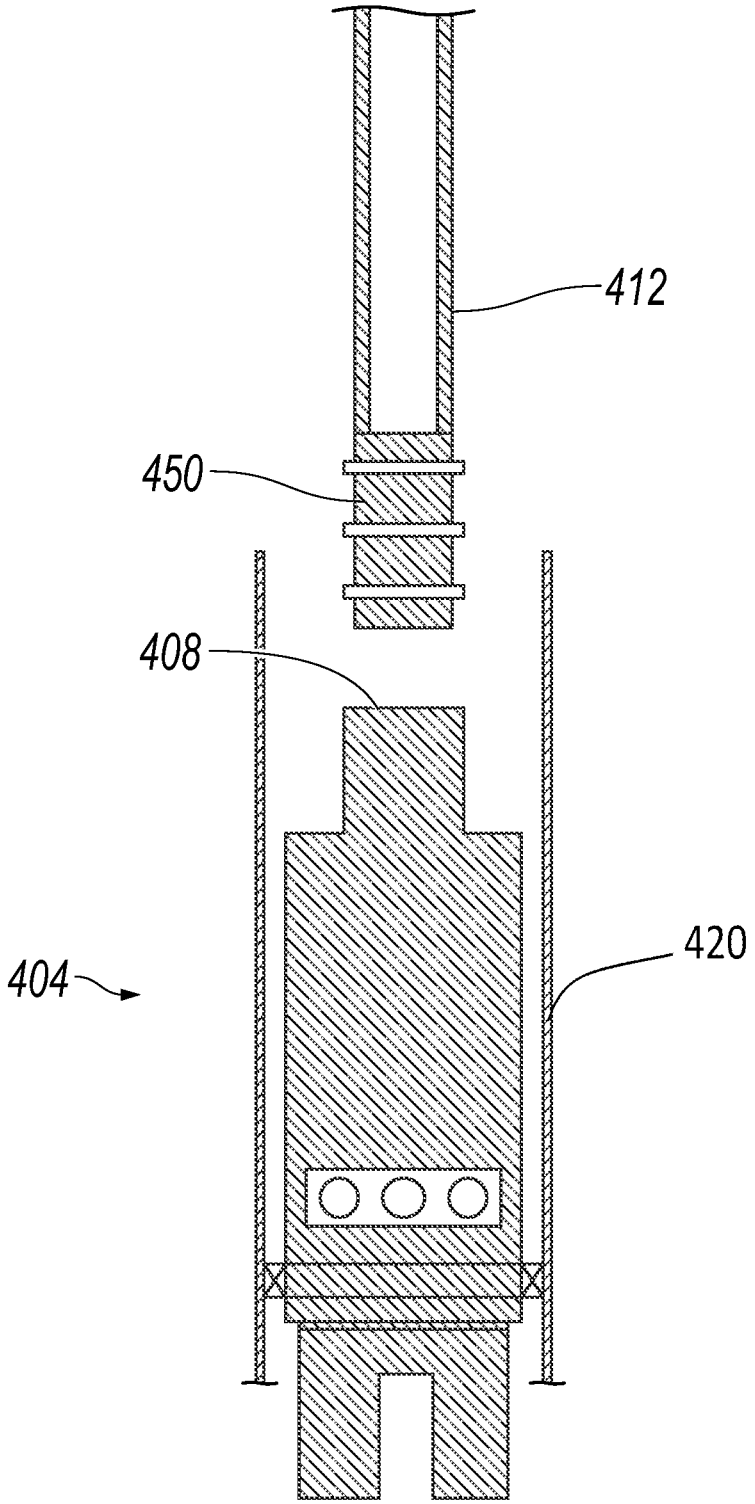
FIG. 4 is a side cross-sectional view of an example hydraulic top drive.

FIG. 4 is a side cross-sectional view of an example hydraulic top drive 404. The hydraulic top drive 404 is substantially similar to the hydraulic top drive 204 in FIG. 2, with the exception of any differences described herein. The top drive 404 includes a fluid inlet 408 that is configured to connect to inlet tubing 412 by a stinger 450, similar to a polished bore receptacle (PBR) arrangement used in other wellbore systems. In such an arrangement, the top drive 404 can be tripped in and out of the wellbore (that is, received or removed from the submersible pump 202) by the return tubing 420.

Figure 5:
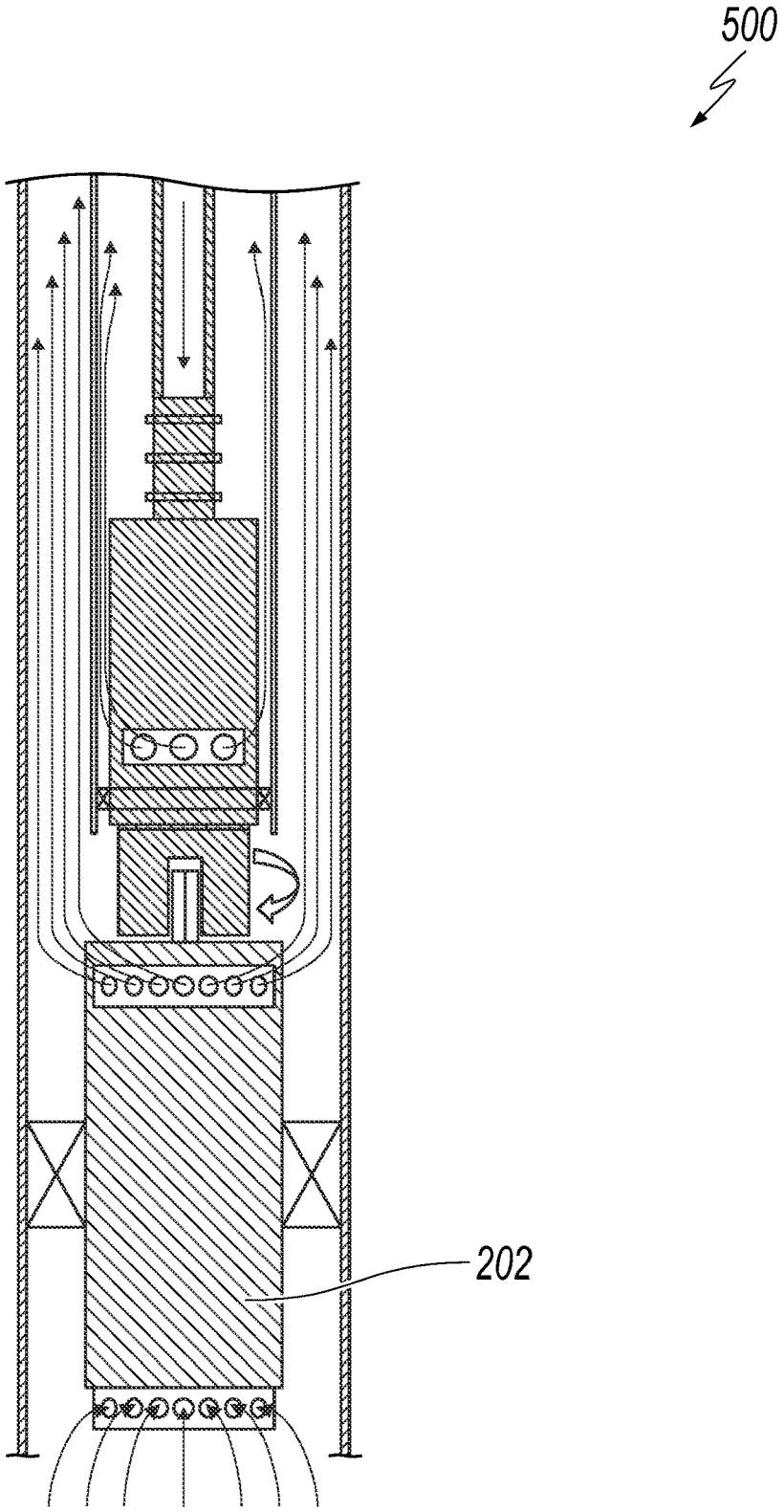
FIG. 5 is a side cross-sectional view of an example downhole-type pump driven by a hydraulic top drive.

FIG. 5 is an example HSP 500 with a downhole-type pump 202 driven by a hydraulic top drive 404. The illustrated arrangement is substantially similar to that illustrated in FIG. 2, with the exception of any differences described herein. Primarily, the top drive 404 includes a stinger inlet tubing arrangement previously described.

Figure 6:
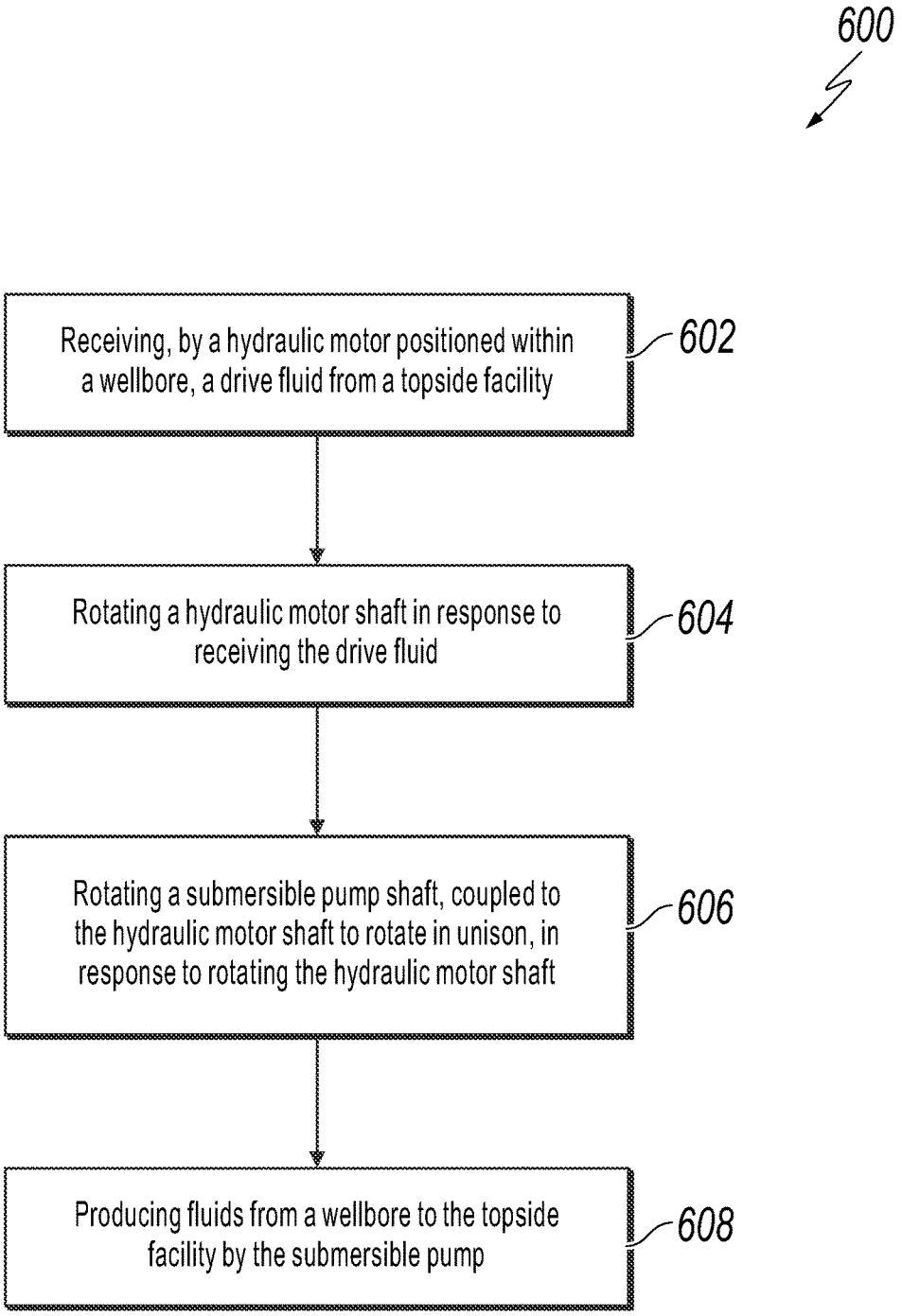
FIG. 6 is a flowchart of an example method that can be used with aspects of this disclosure.

FIG. 6 is a flowchart of an example method 600 that can be used with aspects of this disclosure. At 602, a hydraulic motor, such as hydraulic motor 206, positioned within a wellbore, such as wellbore 102, receives a drive fluid from a topside facility, such as topside facility 108. At 604, a hydraulic motor shaft is rotated in response to receiving the drive fluid. At 606, a submersible pump shaft, coupled to the hydraulic motor shaft to rotate in unison, is rotated in response to rotating the hydraulic motor shaft. At 608, fluids from a wellbore are produced to the topside facility by the submersible pump.

In some implementations, the drive fluid is emitted from the hydraulic motor and isolated from the producing fluids, for example by the return tubing 220. In such implementations, the drive fluid is then returned uncontaminated (at least, not commingled with the production fluid) to the topside facility. That is, the drive fluid and the production fluid are each returned in separate lines. Such an implementation allows the drive fluid to be re-used, reducing the consumable fluid necessary to operate such a hydraulic top drive.

In some implementations, the drive fluid is emitted from the hydraulic motor such that it is commingled with the production fluid. That is, the drive fluid and the production fluid are returned in a single line to the topside facility. Depending on the composition of the drive fluid, the drive fluid may be able to be removed from the production fluid during conditioning. In some implementations, compatible fluids, such as conditioned dead oil, can be used as the drive fluid. Such an implementation eliminates the need for consumable hydraulic fluid that may be needed for drive fluid in other implementations.

The top drive implementations described within this disclosure are modular and separable from the submersible pumps described herein. As such, during installation, after the submersible pump has been installed within a production wellbore, the hydraulic motor is received by the submersible pump. After operating for a duration of time, the hydraulic motor can be separated from the submersible pump while the submersible pump remains at a fixed location within the wellbore, for example, at a production depth. Such a separation can occur due to overhaul schedules, hydraulic motor sizing changes due to changing production properties of the wellbore, or many other reasons. A new hydraulic motor or the same overhauled hydraulic motor is then received by the submersible pump, and production can resume.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A top drive for a submersible pump located downhole of the top drive, the top drive comprising:

a drive fluid inlet located at an uphole end of a body of the top drive for receiving drive fluid from an inlet tubing;

a removable hydraulic motor forming at least a portion of the body of the top drive, the removable hydraulic motor being configured to be driven by the drive fluid received in the drive fluid inlet and being connectable to and separable from the submersible pump;

a receiver located at a downhole end of the removable hydraulic motor and being configured to mate with the submersible pump;

a drive fluid outlet located at the body of the top drive and downhole of the drive fluid inlet, the drive fluid outlet being configured to expel the drive fluid after the drive fluid has flowed through the removable hydraulic motor; and a return tubing surrounding the body of the top drive and the inlet tubing to form a return annulus between the return tubing and the inlet tubing that isolates production fluids from drive fluid that has been expelled from the drive fluid outlet.

2. The top drive of claim 1, wherein the drive fluid inlet is configured to connect to the inlet tubing to fluidically connect the top drive to a fluid drive source at a topside facility.

3. The top drive of claim 2, wherein the return tubing is configured to connect the drive fluid outlet to the topside facility.

4. The top drive of claim 1, further comprising a packer located between the drive fluid outlet and the submersible pump to further isolate the production fluids from the drive fluid that has been expelled from the drive fluid outlet.

5. The top drive of claim 1, wherein the receiver comprises a central profile defining a rotatable receptacle configured to receive a corresponding profile at an uphole end of a shaft of the submersible pump.

6. The top drive of claim 5, wherein each of the central profile and the corresponding profile comprises a hexagonal shape.

7. The top drive of claim 1, wherein the return tubing forms a concentric arrangement with the inlet tube.

8. A method of driving a submersible pump within a wellbore, the method comprising:

receiving drive fluid at a drive fluid inlet located at an uphole end of a body of a top drive through an inlet tubing from a topside facility;

rotating a shaft of a removable hydraulic motor of the top drive in response to receiving the drive fluid, the removable hydraulic motor forming at least a portion of the body of the top drive and being connected to and separable from the submersible pump;

expelling the drive fluid from a drive fluid outlet located at the body of the top drive and downhole of the drive fluid inlet after the drive fluid has flowed through the removable hydraulic motor;

rotating a shaft of the submersible pump in unison with the shaft of the removable hydraulic motor as a result of a direct coupling between shaft of the submersible pump and a receiver formed in the shaft of the removable hydraulic motor, the receiver being located at a downhole end of the removable hydraulic motor;

pumping production fluids from the wellbore to the topside facility with the submersible pump; and flowing the drive fluid that has been expelled from the drive fluid outlet within an annulus between the inlet tubing and a return tubing that surrounds the body of the top drive and the inlet tubing to isolate the drive fluid from the production fluids.

9. The method of claim 8, further comprising returning the drive fluid to the topside facility.

10. The method of claim 8, further comprising receiving the removable hydraulic motor at the submersible pump.

11. The method of claim 8, further comprising separating the removable hydraulic motor from the submersible pump.

12. The method of claim 11, wherein the removable hydraulic motor is a first removable hydraulic motor, the method further comprising receiving the first removable hydraulic motor or a second removable hydraulic motor at the submersible pump after separating the first removable hydraulic motor from the submersible pump.

13. A system comprising:

a submersible pump configured to pump production fluids from a wellbore within a geologic formation to a topside facility; and a top drive for the submersible pump, the top drive being located uphole of the submersible pump and comprising:

a drive fluid inlet located at an uphole end of a body of the top drive for receiving drive fluid from an inlet tubing, a removable hydraulic motor forming at least a portion of the body of the top drive, the removable hydraulic motor being configured to be driven by the drive fluid received in the drive fluid inlet and being connectable to and separable from the submersible pump, a receiver located at a downhole end of the removable hydraulic motor and being configured to mate with the submersible pump, a drive fluid outlet located at the body of the top drive and downhole of the drive fluid inlet, the drive fluid outlet being configured to expel the drive fluid after the drive fluid has flowed through the removable hydraulic motor, and a return tubing surrounding the body of the top drive and the inlet tubing to form a return annulus between the return tubing and the inlet tubing that isolates production fluids from drive fluid that has been expelled from the drive fluid outlet.

14. The system of claim 13, wherein the drive fluid inlet is configured to connect to the inlet tubing to fluidically connect the top drive to a fluid drive source at the topside facility.

15. The system of claim 14, wherein the return tubing is configured to connect the drive fluid outlet to the topside facility.

16. The system of claim 13, further comprising a packer located between the drive fluid outlet and the submersible pump to further isolate the production fluids from the drive fluid that has been expelled from the drive fluid outlet.

17. The system of claim 13, wherein the receiver comprises a central profile defining a rotatable receptacle configured to receive a corresponding profile at an uphole end of a shaft of the submersible pump.

18. The system of claim 17, wherein each of the central profile and the corresponding profile comprises a hexagonal shape.

19. The system of claim 13, wherein the top drive is removable from the submersible pump while the submersible pump remains within the wellbore.

* * * * *